US010000940B2

(12) United States Patent
McLoughlin et al.

(10) Patent No.: US 10,000,940 B2
(45) Date of Patent: Jun. 19, 2018

(54) BUSINESS PRODUCTIVITY ROOM

(71) Applicant: Six Continents Hotels, Inc., Atlanta, GA (US)

(72) Inventors: Andrew James McLoughlin, Henley-on Thames (GB); Sangeetha Ramkumar, Atlanta, GA (US); Thomas Zachary Lloyd, London (GB); Sally Kyoko Halls, London (GB); Luke Neil Pearson, London (GB); Nick Stanley Borg Carpenter, London (GB); Jack Charles Cheatle, London (GB); Timothy Robert Jones, Adderbury (GB)

(73) Assignee: SIX CONTINENTS HOTELS, INC., Atlanta, GA (US)

( * ) Notice: Subject to any disclaimer, the term of this patent is extended or adjusted under 35 U.S.C. 154(b) by 0 days. days.

(21) Appl. No.: 14/949,606

(22) Filed: Nov. 23, 2015

(65) Prior Publication Data

US 2016/0076266 A1 Mar. 17, 2016

Related U.S. Application Data

(63) Continuation of application No. 14/466,710, filed on Aug. 22, 2014, now Pat. No. 9,194,143.

(Continued)

(51) Int. Cl.

*E04H 3/02* (2006.01)
*A47C 17/00* (2006.01)

(Continued)

(52) U.S. Cl.

CPC ..... *E04H 3/02* (2013.01); *A47C 17/00* (2013.01); *A47C 17/86* (2013.01); *A47C 19/22* (2013.01); *E04F 19/00* (2013.01)

(58) Field of Classification Search

CPC .... E04H 1/02; E04H 3/08; E04H 3/02; A47C 17/00

See application file for complete search history.

(56) References Cited

U.S. PATENT DOCUMENTS 2,495,494 A 1/1950 Ziegenfuss
2,563,752 A 8/1951 Rowland (Continued)

FOREIGN PATENT DOCUMENTS

AT 183188 B 9/1955
AT 186385 B 8/1956

(Continued)

OTHER PUBLICATIONS

"Floor plan Bellagio hotel Salon Suite", [online] Bellagio, Nov. 27, 2014. Retrieved from the Internet: URL:http:jjwww.bellagio.com/images2/hotel/Floorplan-Salone-Suite.gif, 1 page.

(Continued)

*Primary Examiner* — Gisele D Ford

(74) *Attorney, Agent, or Firm* — Kilpatrick Townsend & Stockton LLP

(57) ABSTRACT

A hotel room with furniture arranged for optimal television viewing from a bed and another location, such as a sofa or second bed. Furniture pieces are connected or closely aligned together and are arranged so that they provide premium viewing for a television, regardless of a location of a person within the hotel room. To this end, embodiments utilize furniture arrangements where the bed and/or sofa are turned at an angle to the walls of the room, and the room is laid out efficiently to account for this different design affect.

18 Claims, 3 Drawing Sheets

Related U.S. Application Data

(60) Provisional application No. 61/869,593, filed on Aug. 23, 2013.

(51) Int. Cl.

| | |
|---|---|
| ***E04F 19/00*** | (2006.01) |
| ***A47C 19/22*** | (2006.01) |
| ***A47C 17/86*** | (2006.01) |

(56) References Cited

U.S. PATENT DOCUMENTS

| | | | | |
|---|---|---|---|---|
| 2,602,937 | A | 7/1952 | Frey | |
| 2,691,174 | A | 10/1954 | Harrison | |
| 2,734,199 | A | 2/1956 | Blake | |
| 2,781,524 | A | 2/1957 | Andes | |
| 2,806,228 | A | 9/1957 | Ziegenfuss | |
| 2,904,796 | A | 9/1959 | Frey | |
| 2,909,789 | A | 10/1959 | Bailey | |
| 2,976,544 | A | 3/1961 | Mugler | |
| 2,997,723 | A | 8/1961 | Nicassio | |
| 3,015,112 | A | 1/1962 | Wachsman | |
| 3,049,723 | A | 8/1962 | Thierfelder | |
| 3,058,123 | A | 10/1962 | Pink et al. | |
| 3,059,246 | A | 10/1962 | Shlaes | |
| 3,084,351 | A | 4/1963 | Kulp et al. | |
| 3,106,724 | A | 10/1963 | Kamp | |
| 3,623,284 | A | 11/1971 | Meyer | |
| 3,742,932 | A * | 7/1973 | Greenspan | E04H 3/08 104/88.01 |
| 3,775,919 | A | 12/1973 | Fulton et al. | |
| 3,952,465 | A | 4/1976 | Masiello | |
| 4,198,791 | A | 4/1980 | Kalkaslief | |
| 4,612,741 | A | 9/1986 | Jacobson | |
| 4,718,205 | A | 1/1988 | Taylor | |
| 6,243,993 | B1 | 6/2001 | Swensson | |
| 6,256,936 | B1 | 7/2001 | Swensson et al. | |
| 6,405,491 | B1 * | 6/2002 | Gallant | E04B 2/74 52/220.1 |
| 6,931,676 | B1 | 8/2005 | Henley, Jr. | |
| 8,333,038 | B2 * | 12/2012 | Bates | A47B 95/008 52/238.1 |
| 8,621,787 | B2 | 1/2014 | Barry et al. | |
| 2003/0226323 | A1 | 12/2003 | Travez et al. | |
| 2008/0313973 | A1 * | 12/2008 | Butler Rolf | E04H 3/08 52/79.1 |
| 2009/0031642 | A1 | 2/2009 | Donovan | |
| 2009/0129093 | A1 * | 5/2009 | Wittig | F21V 7/005 362/297 |
| 2010/0235985 | A1 | 9/2010 | Singer | |
| 2014/0096461 | A1 | 4/2014 | McLoughlin et al. | |
| 2015/0052832 | A1 | 2/2015 | McLoughlin et al. | |

FOREIGN PATENT DOCUMENTS

| | | | |
|---|---|---|---|
| EP | 1020143 | B1 | 4/2003 |
| GB | 820700 | A | 9/1959 |
| GB | 863893 | A | 3/1961 |
| GB | 873096 | A | 7/1961 |
| JP | 04293865 | A | 10/1992 |
| JP | 2002315190 | A | 10/2002 |
| JP | 2005087452 | A | 4/2005 |
| WO | 2015027158 | A2 | 2/2015 |
| WO | 2015027158 | A3 | 4/2015 |

OTHER PUBLICATIONS

"River Rock Suite", [online] Hopelake Lodge, Nov. 30, 2011. Retrieved from the Internet: URL:http://hopelakelodge.comjwp-contentjuploads/2011/11/River-Rock.jpg, 1 page.

Iori, Kenneth, "Salone Suite in the Bellagio Hotel Las Vegas", [online] YouTube.com, Aug. 13, 2010. Retrieved from the Internet: URL:https://www.youtube.comjwatch?v=8HGrMOGwzeg, 1 page.

PCT/US2014/052299, "Invitation to Pay Additional Fee and Partial Search Report", dated Dec. 3, 2014, 6 pages.

PCT/US2014/052299, "International Search Report and Written Opinion", dated Feb. 13, 2015, 18 pages.

PCT/US2014/052299, "International Preliminary Report on Patentability", dated Mar. 3, 2016, 12 pages.

* cited by examiner

BUSINESS PRODUCTIVITY ROOM

CROSS-REFERENCES TO RELATED APPLICATIONS

This application is a continuation of U.S. application Ser. No. 14/466,710, filed Aug. 22, 2014, which application claims the benefit of U.S. Provisional Application No. 61/869,593, filed Aug. 23, 2013, the entire disclosures of each of these commonly owned patent applications are expressly incorporated herein by reference in their entirety.

BACKGROUND

A hotel is an establishment that provides paid lodging on a short term basis. Hotels typically consist of a single or multiple buildings having multiple rooms in each building. Each room includes a bed, a bathroom, and many modern conveniences, such as a telephone, an alarm clock, a television, a safe, a mini-bar, and other amenities.

Often, when business travelling, a hotel guest will desire to work in a hotel room. To this end, many hotel rooms include a desk or other work area, but often these work areas are not well integrated into the room.

Many hotel rooms include a place to sit other than a bed. Often, the room is arranged so that a guest can watch television from either the seating area or the bed, but rotation of the television is typically required, and the viewing angles will not be optimal for one or both of the locations.

The following references may be related to this technology.

| Patent Number | Title | Inventor |
|---|---|---|
| 6,931,676 | Corner Bed Arrangement | Henley |
| 6,243,993 | Modular Healthcare Room Interior | Swensson |
| 3,106,724 | Corner Bed Structure | Ewald |
| 3,084,351 | Combined Bed And Lounge | Harry |
| 3,059,246 | Combination Sofa-bed And Table Structure | Jacquelyn |
| 3,058,123 | Convertible Corner Bed Ensemble | Chester |
| 3,049,723 | Convertible Bed | Ervin |
| 3,015,112 | Sofa Bed | William |
| 2,997,723 | Combined Studio Couch And Bed | Angelo |
| 2,976,544 | Piece Of Furniture Usable As Sofa Or Bed | Charles |
| 2,909,789 | Sofa Bed Assembly | Theodore |
| 2,904,796 | Combined Sofa Bed And End Table | Louis |
| 2,806,228 | Sofa-bed | Truman |
| 2,781,524 | Motorized Beds | Chester |
| 2,734,199 | Utility Piece Of Furniture | Nathan |
| 2,691,174 | Bed And Lounge Unit | Morton |
| 2,602,937 | Sofa Bed | Louis |
| 2,563,752 | Matched Bed | Jasper |
| 2,495,494 | Twin Bed And Lounge | Truman |
| 2010/0235985 | Sofa Bed | Singer |
| JP 2005087452A | Sofa-Bed | Uzawa |
| GB 873096A | Combined Sofa Bed, Divan And Desk | Frey |
| GB 863893A | Combined Sofa Bed And End Member | Frey |
| GB 820700A | A Combined Bed And Seat | Robert |
| EP 1020143B1 | Upholstered Corner Seat Convertible Into Double Bed | Brisson et al. |
| AT 186385B | A Convertible Double Bed To Sitting Area | Brieger |
| AT 183188B | A Convertible Double-ended Seating Area | Duchek |

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to a hotel room that is arranged to optimize business productivity. Specifically, the hotel room is arranged with a relationship between elements (bed-sofa-desk) that enables a guest to seamlessly move between need states and enables the guest to blend how she works and rests in such a way as to make the transition and relationship between these elements feel natural. To this end, the bed, sofa, and the desk form a triangle in the room, with the seating of the sofa and foot of the bed directed generally towards the triangle. The triangle creates a sense that the often separate activities that are undertaken in these areas can be easily integrated. The physical and implied barriers that standard guestrooms create that inhibit hotel guests' natural working and resting patterns are removed, allowing the guests to use the room more intuitively.

In embodiments, the triangle includes no angles that are more than 90 degrees, which directs the three elements towards each other. The angles between sides can be affected by the shape of the room, but the sides are preferably of short lengths so that the three features are close together. In addition, having the foot of the bed and the seating surfaces of the sofa directed at least partly towards the triangle center integrates the three activities.

Additional embodiments herein are directed to a hotel room having an integrated sofa and bed. The sofa and bed are connected to each other at an angle that provides comfort in seating on the sofa, does not interfere with access to the bed, and provides optimal viewing of a single television in the room. The sofa and bed can have a table or other structure between them, or can be directly connected to each other.

In embodiments, the angle between the bed and the sofa is 45 degrees, with the length of the bed forming this angle to the length of the sofa. This angle may vary based upon the configuration of the room, the furniture in the room, and/or access needed in the room. The end of the sofa adjacent to the head of the bed is connected to the bed, and the length of the bed extends at the angle to the sofa and sidewalls of the room. The foot of the bed is directed toward a television in the room. The television is also located so that it can be viewed, directly from the sofa without the guest turning his or her head too much. That is, the television is generally directly in front of the person sitting on the sofa.

In some rooms utilizing the integrated sofa and bed, an angled wall is provided behind a headboard of the bed. The wall is a vertical wall, and is angled relative to the typically perpendicular, vertical sidewalls of the room, and can match the direction of the headboard of the bed. The bathroom for the room can be located on the opposite side of the angled wall from the bed. This angled position of the wall permits no wasted space in the room behind the headboard of the bed, and permits additional space for bathroom fixtures, such as a sink or shower.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

In general, aspects described herein are directed to at least three features that make a hotel room more comfortable than prior guest rooms. These features, which are described throughout this document, can be used separately in a room, or a hotel room can include any two of the three, or can include all three features. First, a sofa and a bed can be integrated into a single piece of furniture, creating a continuous, efficient line. The bed is angled relative to the sofa so that seating on the sofa is available, and access to the bed is not limited. In addition, the bed can be tilted relative to the room so that space is available behind the headboard, for example to expand a bathroom for the room. Second, a desk, a bed, and a sofa can be positioned at the corners of a triangle, creating an integrated space for the three most commonly used features of the room, and integrating work, sleep, and casual time. To enhance this effect, the foot of the bed and the seating surface of the sofa are directed generally towards the center of the triangle. Third, a seating surface of a sofa and a foot of a bed are directed towards a television in the room, providing optimal viewing experiences.

Figure 1:
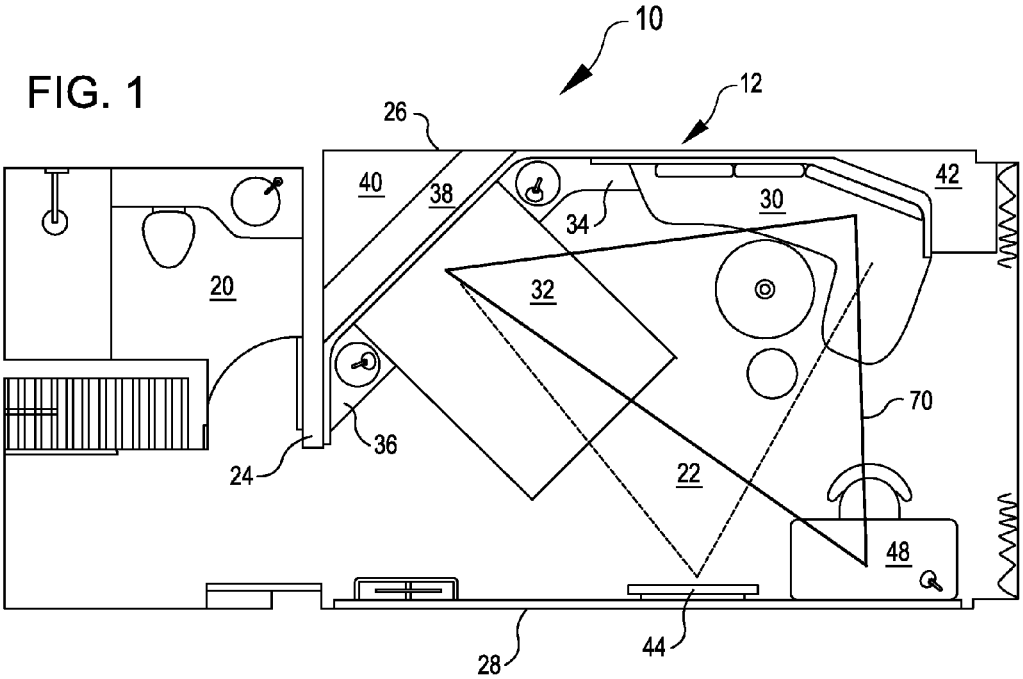
FIG. 1 is a top view of a representation of a hotel room layout showing a retrofit hotel room incorporating an integrated sofa and bed in accordance with embodiments.

Referring now to the drawings, in which like reference numerals represent like parts throughout the several views, FIG. 1 shows a retrofit hotel room 10 incorporating an integrated sofa and bed 12 in accordance with embodiments. By "retrofit", we mean a hotel room that has been remodeled from a standard or prior art hotel room layout into a new layout consistent with the description herein.

The hotel room 10 includes a bathroom 20 and common area 22, separated by a wall 24. In the embodiment shown in the drawings, the bathroom wall 24 is perpendicular to sidewalls 26, 28 for the hotel room 10. These features are standard for many prior art hotel rooms.

In the embodiment shown in FIG. 1, the integrated sofa and bed 12 have been added to an existing hotel room for a retrofit of the hotel room. The wall 24 was already in position and was not demised as part of the retrofit. The bathroom 20 and common area 22 thus maintain their original configurations.

The integrated sofa and bed 12 in embodiments is a single, integrated piece of furniture that includes a sofa 30 and a bed 32. The piece of furniture may have to be assembled, but when in place, the sofa 30 and the bed 32 are connected together. The sofa 30, which could be of any configuration, is shown in FIG. 1 as a sofa/lounge with an L-shaped configuration. In the embodiment shown in FIG. 1, the sofa 30 is connected to the bed 32 by a nightstand 34. A second nightstand 36 is positioned on an opposite side of the bed 32.

The integrated sofa and bed 12 can extend at least partly along a common wall, in FIG. 1, the sidewall 26 at the top of the drawing. The head of the bed 32 aligns against an angled wall 38 which extends from the sidewall 26 to the bathroom wall 24 at an acute angle, and in embodiments at approximately a 45 degree angle to these walls, although the bed could be at a different acute angle. This angled wall 38 and the bathroom wall 24 form a dead space 40 behind the headboard of the bed 32. However, the angled wall 38 need not go to the ceiling, and this space could be used for lighting, bookshelves, or other room features.

The sofa 30 is aligned along the sidewall 26, but in embodiments, as shown in FIG. 1, one end of the sofa, distal of the bed 32, is slightly tilted toward the middle of the common area 22 by an offset 42. The offset 42 directs a person sitting on the sofa 30 towards a television 44. To this end, the offset causes the distal end of the sofa to form an obtuse angle with the rest of the sofa.

A desk 48 is positioned in the hotel room 10 so that the desk 48, the bed 32, and the sofa 30 are positioned at points of a triangle, represented by the triangle 70 in FIG. 1. The points of the triangle are located generally at a seating surface of the sofa, a middle head location on the bed, and a central work surface of the desk. This triangular arrangement directs activity to a central location in the room, and enables a guest to seamlessly move between work, sleep, and casual states. In addition, by directing these three elements into the triangle, the arrangement enables the guest to blend how he or she works and rests in such a way as to make the transition and relationship between these elements feel natural. Because of the triangular relationship, the elements are closer together in a room than in usual hotel rooms. In addition, the seating of the sofa and foot of the bed directed generally towards the triangle, emphasizing the connectivity of the three elements. The triangle creates a sense that the often separate activities that are undertaken in these areas can be easily integrated. The physical and implied barriers that standard guestrooms create inhibit guests' natural working and resting patterns. The triangular, integrated space removes these physical and implied barriers, allowing the guest to use the room more intuitively.

In embodiments, the triangle includes no angles that are more 90 degrees, which directs the three elements towards a center of the triangle and towards each other. The angles between sides can be affected by the shape of the room, but the elements are laid out so that the sides of the triangles have the shortest possible lengths, placing the three elements close together. In addition, having the foot of the bed and the seating surfaces of the sofa directed at least partly towards the triangle center integrates the three activities performed at these areas.

The inwardly-directed arrangement of the sofa 30 and the bed 32 also permits individuals to either sit on the sofa or lay on the bed and comfortably watch the television 44. The sofa 30 is aligned so that a person can sit comfortably on the sofa and look directly at the television 44, without having to turn or contort the neck or head. This alignment is true along the sofa due to the fact that the sofa includes a straight portion along the wall 26 and directly across from the television, and the distal end of the sofa directed inward by the offset 42. Likewise, a person lying on the bed is directed towards the television because the bed is arranged so that the footboard or foot end of the bed 32 is aligned towards the television 44. This position allows a person to lie on the bed, with his or her head on pillows, and to watch the television 44 along the length of the bed 32 (i.e., towards the foot of the bed). The preferred viewing arrangements from the sofa and the bed are shown pictorially via the dotted lines in FIG. 1. Moreover, the angle of the sofa relative to the bed allows the sofa and bed to be aligned adjacent to each other, but there is plenty of room to access the bed 32 from the sofa side, and to sit on the sofa 30 without interference by the bed. The offset of the bedside table 34 aids in this arrangement.

The angle of bed 32 relative to the room, and the arrangement of the triangle 70 can be changed so as to allow appropriate access in a room. The bed angle may be changed according to a width or length of the room, or desired furniture for the room. However, in embodiments such as shown in FIG. 1, the bed 32 approaches an angle of 45° relative to the wall 26. As described above, however, this angle and the shape of the triangle may change in accordance with the configuration of the room, the furniture in the room, and/or desired configuration or access for the room. Due to room size and configuration limitations, the bed and/or the sofa may not be perfectly aligned with the television, but putting the bed at an angle to the sidewalls of the room allows for better overall combined viewing from the bed and sofa.

Figure 2:
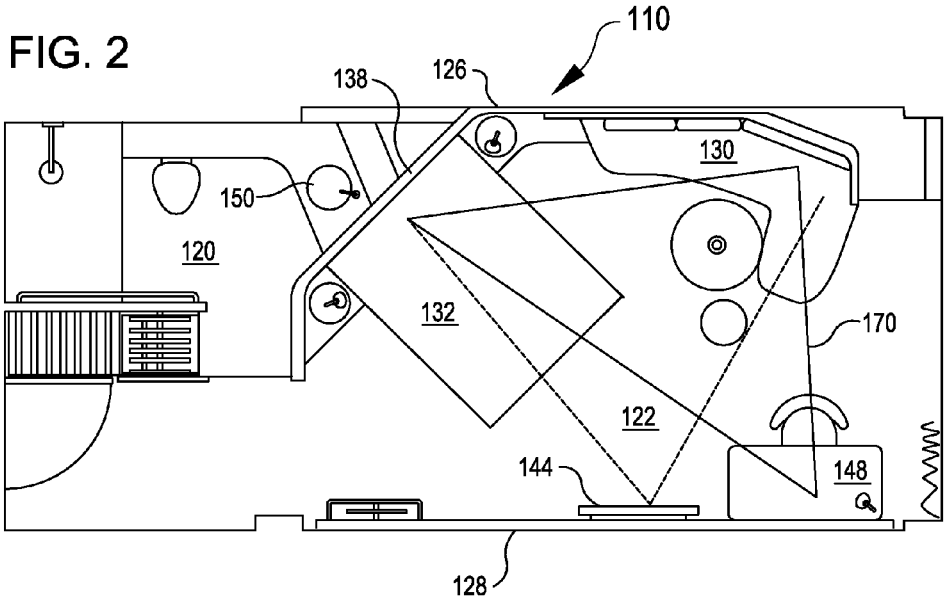
FIG. 2 is top plan of a hotel room layout, similar to FIG. 1, in which a new build is done for a hotel room in accordance with embodiments.

FIG. 2 shows an alternate embodiment in which, instead of a retrofit to an existing generally rectangular-shaped hotel room, a new build is done for a generally rectangular-shaped room 110. The reference numerals in FIG. 2 are for like elements as those in FIG. 1, with a "1" added before the numbers in FIG. 2. In this particular room, the features of the common area are the same, except for the separator wall, now labeled 138 in FIG. 2. In the room 110 shown in FIG. 2, the separator wall 138 serves as an angled wall between the bathroom 120 and the headboard of the bed in the common area 122. The angled wall 138 can be any angle, but in embodiments is an acute angle, and in some arrangements, 45 degrees. Utilizing this configuration, the dead space 40 in the room 10 of FIG. 1 is eliminated, and instead of being dead space, this area can be used for the bathroom 120. In the embodiments shown in the drawings, the bathroom 120 includes a sink 150 mounted in the opening behind the wall 138. However, a toilet, shower, or other features of the bathroom can be mounted in the space. As such, this configuration eliminates most dead space in the room, but yet still allows for optimal television viewing from the bed and the sofa.

The sofa 30 and bed 32 do not necessarily have to be connected together, and the arrangements described herein can be provided with the two elements spaced from one another in the room. However, by providing a table 34 or other structure in between the two pieces of furniture, space in the room is fully utilized, and the edges of the room are well rounded, giving a pleasing internal layout of the furniture.

Figure 3:
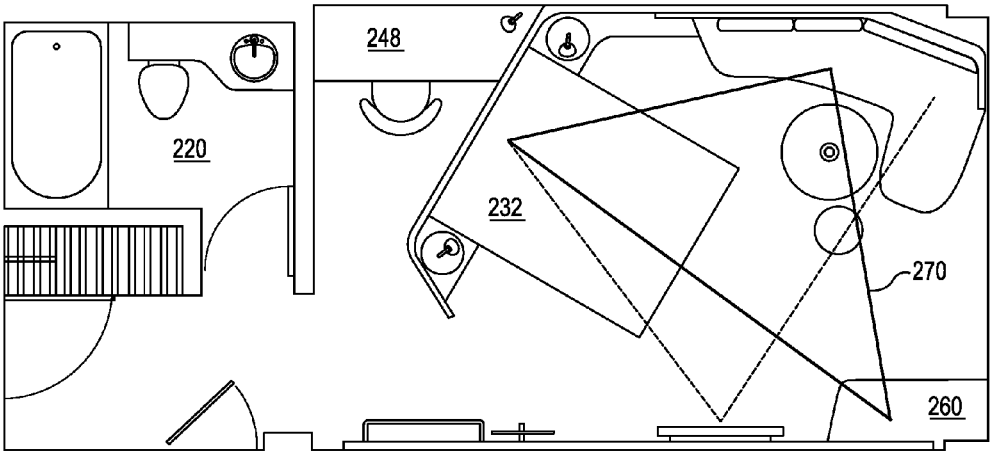
FIG. 3 is a top plan of yet another hotel room layout, in which a bed is spaced from a separator wall for a bathroom, allowing a pocket space for a desk between the bathroom and wall in accordance with embodiments.

Multiple different configurations can be provided. As examples, FIG. 3 shows a separate embodiment in which a bed 232 is spaced further from a bathroom 220, allowing a pocket space for a desk 248. This configuration does not provide the desk-bed-television triangle feature of FIGS. 1 and 2, but a like feature is created with a refrigerator 260, causing the refrigerator to form the third point of the triangle 270, instead of a desk. This feature brings balance to the room, but not necessarily the work/rest/casual blend provided by triangles 70, 170 that include a desk 48, 148. The layout of FIG. 3 also provides the advantageous viewing layout for the television, as shown by the dotted lines in the drawing.

Figure 4:
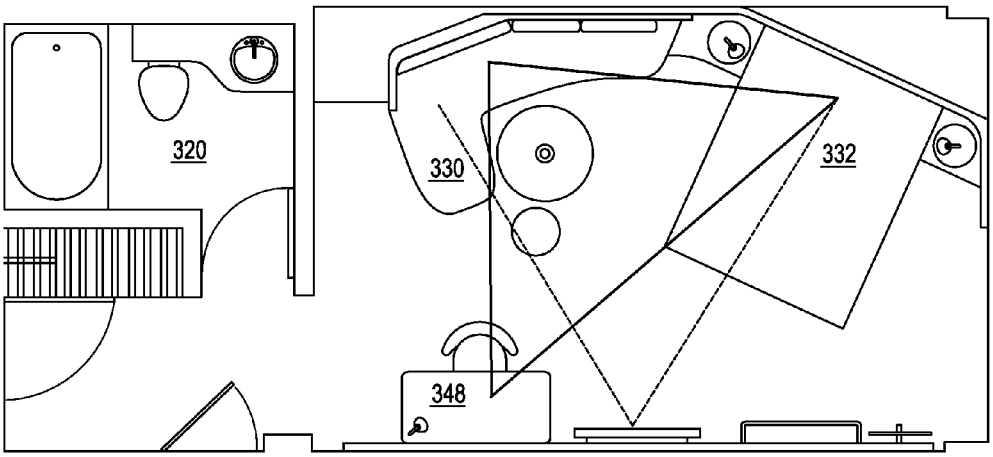
FIG. 4 is a top plan of still another hotel room layout in which a bed is located on an opposite side of the room from a bathroom separator wall, with the sofa located adjacent to the bathroom separator wall in accordance with embodiments.
Figure 5:
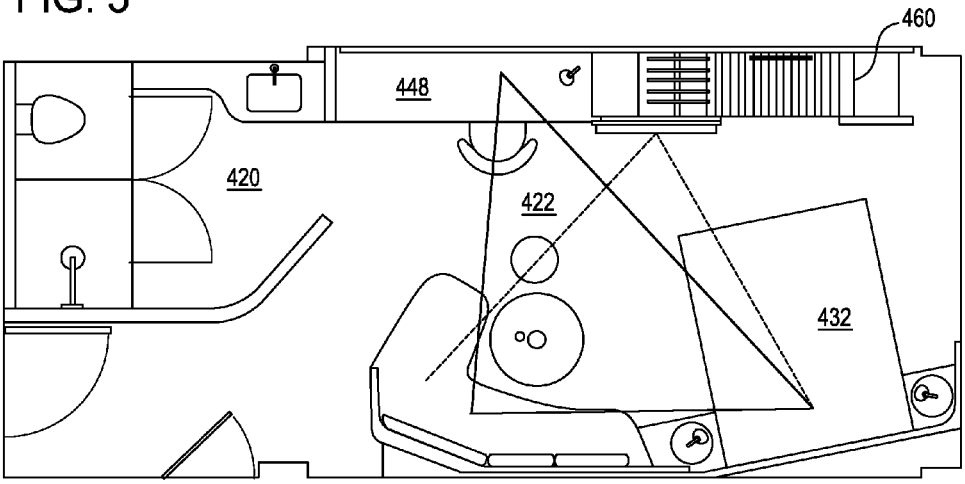
FIG. 5 is a top plan of still yet another hotel room layout, with a bed located diagonally from a bathroom, with the bathroom having a doorway that opens into the common area in accordance with embodiments.

FIG. 4 shows a bed 332 located on an opposite side of the room from the bathroom, with the sofa 330 located adjacent to the bathroom 320. Similarly, FIG. 5 shows a bed 432 located diagonally from a bathroom 420, with the bathroom having a doorway that opens into the common area 422. In the embodiment shown in FIG. 5, a media cabinet 460 is utilized as opposed to just a television 44. As can be understood, multiple different furniture pieces can be utilized in a room.

Figure 6:
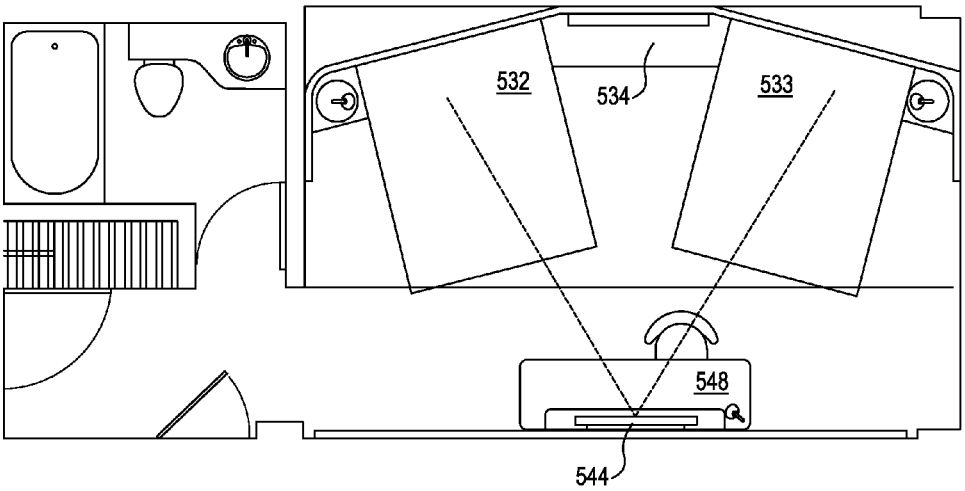
FIG. 6 is a top plan view illustrating another embodiment of a hotel room layout in which two double beds are arranged at angles so that they are optimally aligned with a television and desk in accordance with embodiments.

FIG. 6 shows yet another embodiment in which two double beds are arranged at angles so that they are optimally aligned with a television 544. The two double beds 532, 533, include a common side table 534. This layout does not include a sofa or the triangle concept, but angles are used as above to make television viewing more comfortable.

Thus, in embodiments, a hotel room is provided, having four walls surrounding a room, and at least three of the walls defining a common area of the room; a television in the common area of the room; a bed in the common area of the room and arranged so that a foot of the bed points substantially towards the television; and a sofa at an acute angle relative to the bed and arranged to face substantially towards the television. The four walls may include coplanar sets of walls defining a rectangle, with the sofa arranged along one of the walls, and the bed arranged at the acute angle to the one of the walls. The acute angle may be any acute angle, but in embodiments is approximately 45 degrees.

The bed may connected to the sofa by an end table, and an end of the sofa distal to the bed may include a distal end of the sofa offset at an obtuse angle with the remainder of the sofa, with a seating area of the sofa at the offset being generally directed toward the television. The sofa may extends along one wall, and the bed may extend at the acute angle to the one wall and into the room and towards the television.

The hotel room may include a, and an angled wall between the bathroom and the bed, with the angled wall extending at an acute angle to at least one of the four walls, and a head for the bed extending against and/or parallel to the angled wall.

A sink may be included in the bathroom on an opposite side of the angled wall from the bed and within a triangular space at least partly defined by the angled wall. In addition or alternatively, the bathroom can be arranged so that a wall is aligned against a head of the bed at an angle to sidewalls of the room, with the bathroom being on the opposite side of the wall.

Embodiments are additionally directed to a hotel room, having four walls defining a common area of the room; a bed; a sofa; and a desk; the bed, the sofa, and the desk being arranged so that a seating surface of the sofa, a middle head location on the bed, and a work surface of the desk form points of a triangle, with no two adjacent sides of the triangle forming an angle greater than approximately 90 degrees; and a foot of the bed and a seating surface of the sofa being directed generally towards a center of the triangle.

Further embodiments are directed to a furniture combination, having a sofa; and a bed connected to the sofa at an acute angle. The bed may be connected to the sofa by an end table.

As can be understood from the above, multiple different configurations can be provided which allow optimal viewing of a television or other feature within a hotel room. The furniture and layout of the room can be appropriately designed for a specific floor plan or desired configuration. In embodiments, however, the furniture pieces are connected or closely aligned together and are arranged so that they provide premium viewing for a television, regardless of a location of a person within the hotel room. To this end, embodiments utilize furniture arrangements where the bed and/or sofa are turned at an angle to the walls of the room, and the room is laid out efficiently to account for this different design affect.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A hotel room, comprising:

four walls defining a common area of the hotel room;

a bathroom including a door to the common area, the bathroom at least partially defined by one of the four walls;

an angled wall extending at an acute angle from the one of the four walls, the angled wall not extending to a ceiling of the hotel room;

a dead space formed in part by the angled wall, the dead space disposed between the bathroom and the angled wall and inaccessible from the common area, the dead space not extending to the ceiling of the hotel room; and a usable space disposed directly between the dead space and the ceiling, and accessible from the common area.

2. The hotel room of claim 1, further comprising a sofa and bed, a head of the bed disposed along the angled wall and the sofa disposed lengthwise at least partly along the one of the four walls.

3. The hotel room of claim 2, wherein the four walls define a rectangle, and the bed is arranged at an acute angle to one of the four walls.

4. The hotel room of claim 2, wherein an end of the sofa distal to the bed is offset at an obtuse angle with the remainder of the sofa.

5. The hotel room of claim 2, wherein the bed is connected to the sofa by an end table.

6. The hotel room of claim 2, wherein:

the bed, the sofa, and a desk are arranged so that a seating surface of the sofa, a middle head location on the bed, and a work surface of the desk form points of a triangle, with no two adjacent sides of the triangle forming an angle greater than 90 degrees; and a foot of the bed and a seating surface of the sofa are directed generally towards a center of the triangle.

7. The hotel room of claim 1, further comprising:

a television in the common area of the room;

a bed in the common area of the room and arranged with a head of the bed disposed along the angled wall and a foot of the bed disposed substantially towards the television; and a sofa at an acute angle relative to the bed and arranged to face substantially towards the television.

8. The hotel room of claim 1, wherein the bathroom and the dead space are separated by an interior wall.

9. The hotel room of claim 1, further comprising at least one of a bookshelf and a lighting element disposed in the usable space.

10. The hotel room of claim 1, wherein the acute angle is approximately 45 degrees.

11. A method of retrofitting a hotel room, the method comprising:

in a hotel room comprising four structural walls, a bathroom, and a common area, adding an angled wall extending at an acute angle from a first structural wall of the four structural walls, the angled wall not extending to a ceiling of the hotel room, wherein adding the angled wall forms a dead space between the angled wall and an existing wall of the bathroom, the dead space not extending to the ceiling of the hotel room;

forming a usable space disposed directly between the dead space and the ceiling, and accessible from the common area; and assembling an integrated piece of furniture including a sofa and a bed, the integrated piece of furniture extending at least partly along the first structural wall, with a head of the bed aligned against the angled wall.

12. The method of claim 11, further comprising:

adding a desk along a second structural wall opposite the first structural wall; and arranging the bed, the sofa, and the desk so that a seating surface of the sofa, a middle head location on the bed, and a work surface of the desk form points of a triangle, with no two adjacent sides of the triangle forming an angle greater than 90 degrees.

13. The method of claim 11, wherein the usable space is configured to receive at least one of a light source and a bookshelf.

14. The method of claim 11, further comprising:

adding a television along a second structural wall opposite the first structural wall; and arranging the bed, the sofa, and the television so that a seating surface of the sofa, a middle head location on the bed, and a screen of the television form points of a triangle, with no two adjacent sides of the triangle forming an angle greater than approximately 90 degrees.

15. A hotel room, comprising:

four walls defining a common area of the hotel room;

a bathroom including a door to the common area, the bathroom at least partially defined by one of the four walls;

an angled wall extending at an acute angle from the one of the four walls, the angled wall not extending to a ceiling of the room; and a vertical space formed in part by the angled wall, the one of the four walls, and a bathroom wall, the vertical space disposed between the bathroom and the angled wall and including a first volume that is inaccessible from the common area and does not extend to the ceiling of the room, and a second volume disposed directly between the first volume and the ceiling, and is accessible from the common area, wherein the second volume is configured to receive at least one of a light source and a bookshelf.

16. The hotel room of claim 15, further comprising a sofa and bed, a head of the bed disposed along the angled wall and the sofa disposed lengthwise at least partly along the one of the four walls.

17. The hotel room of claim 16, wherein the four walls define a rectangle, and the bed is arranged at an acute angle to one of the four walls.

18. The hotel room of claim 15, further comprising:

a television in the common area of the room;

a bed in the common area of the room and arranged with a head of the bed disposed along the angled wall and a foot of the bed disposed substantially towards the television; and a sofa at an acute angle relative to the bed and arranged to face substantially towards the television.

* * * * *